US010226158B2

(12) United States Patent
Ichikawa et al.

(10) Patent No.: US 10,226,158 B2
(45) Date of Patent: Mar. 12, 2019

(54) VACUUM CLEANER

(71) Applicant: TOSHIBA LIFESTYLE PRODUCTS & SERVICES CORPORATION, Kawasaki-shi (JP)

(72) Inventors: Hiromitsu Ichikawa, Owariasahi (JP); Masatoshi Tanaka, Seto (JP); Atsushi Morishita, Hadano (JP); Yukio Machida, Owariasahi (JP); Hiromitsu Murata, Kasugai (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 197 days.

(21) Appl. No.: 15/503,257

(22) PCT Filed: Aug. 17, 2015

(86) PCT No.: PCT/JP2015/073027
§ 371 (c)(1),
(2) Date: Feb. 10, 2017

(87) PCT Pub. No.: WO2016/027771
PCT Pub. Date: Feb. 25, 2016

(65) Prior Publication Data

US 2017/0231450 A1 Aug. 17, 2017

(30) Foreign Application Priority Data

Aug. 18, 2014 (JP) ..... 2014-166236

(51) Int. Cl.
*A47L 9/04* (2006.01)
*A47L 9/28* (2006.01)

(52) U.S. Cl.
CPC ..... *A47L 9/2805* (2013.01); *A47L 9/04* (2013.01); *A47L 9/28* (2013.01); *A47L 9/2842* (2013.01);
(Continued)

(58) Field of Classification Search
CPC ..... A47L 9/2805; A47L 9/28; A47L 9/2842; A47L 9/2884; A47L 9/2894;
(Continued)

(56) References Cited

U.S. PATENT DOCUMENTS 5,664,282 A 9/1997 Castwall et al.
5,720,077 A 2/1998 Nakamura et al.
(Continued)

FOREIGN PATENT DOCUMENTS

CN 85 1 01216 A 1/1987
CN 2054299 U 3/1990
(Continued)

OTHER PUBLICATIONS

International Search Report dated Oct. 27, 2015 in PCT/JP2015/073027 filed Aug. 17, 2015.

*Primary Examiner* — Robert J Scruggs
(74) *Attorney, Agent, or Firm* — Oblon, McClelland, Maier & Neustadt, L.L.P.

(57) ABSTRACT

A vacuum cleaner capable of ensuring communication between a suction port and a dust collecting unit even in a state that a body portion of a cleaning unit has pivoted along an up/down direction relative to a main casing. The body portion is provided on the main casing to be pivotable along the up/down direction. A sliding-contact surface portion is provided in the body portion and curved along a pivoting direction of the body portion. A curved surface portion is provided in the communicating section body and curved along the pivoting direction of the body portion to be brought into sliding contact with the sliding-contact surface portion by pivoting motion of the body portion. A communicating opening is opened in the curved surface portion to communicate with the dust collecting unit.

1 Claim, 8 Drawing Sheets

(52) U.S. Cl.
CPC ..... *A47L 9/2884* (2013.01); *A47L 9/2894* (2013.01); *A47L 2201/04* (2013.01)

(58) Field of Classification Search
CPC ..... A47L 2201/04; A47L 9/2857; A47L 2201/00; A47L 9/2889; A47L 5/30; A47L 11/24; A47L 9/04; E01H 1/0854; E01H 1/0845; E01H 1/0827
See application file for complete search history.

(56) References Cited

U.S. PATENT DOCUMENTS 6,581,239 B1 * 6/2003 Dyson ..... A47L 5/34 15/340.3
2011/0239397 A1 * 10/2011 Dekkers ..... A47L 9/0072 15/319
2013/0312215 A1 11/2013 Kim et al.
2017/0188767 A1 7/2017 Ichikawa et al.

FOREIGN PATENT DOCUMENTS

| | | | |
|---|---|---|---|
| CN | 1337204 | A | 2/2002 |
| CN | 106231972 | A | 12/2016 |
| DE | 102 42 257 | A1 | 4/2003 |
| JP | 7-319542 | A | 12/1995 |
| JP | 2003-52595 | A | 2/2003 |
| JP | 4364441 | B2 | 11/2009 |
| JP | 2011-504113 | A | 2/2011 |
| JP | 2014-150 | A | 1/2014 |
| JP | 2014-132974 | A | 7/2014 |
| KR | 10-1108049 | B1 | 1/2012 |
| WO | WO 2005/055796 | A2 | 6/2005 |

* cited by examiner

VACUUM CLEANER

CROSS-REFERENCE TO RELATED APPLICATIONS

The present application is a National Stage Application of PCT/JP2015/073027 filed on Aug. 17, 2015. The PCT application acclaims priority to Japanese Patent Application No. 2014-166236 filed on Aug. 18, 2014. All of the above applications are herein incorporated by reference.

FIELD

Embodiments described herein relate generally to a vacuum cleaner equipped with a cleaning unit having a suction port communicating with a dust collecting unit and located at a lower part of a vacuum cleaner's main casing facing a cleaning-object surface.

BACKGROUND

Conventionally, there has been known a so-called autonomous-traveling type vacuum cleaner (cleaning robot) which autonomously travels on and cleans a cleaning-object surface while detecting an obstacle or the like by using a sensor or the like as an example. In such a vacuum cleaner, in a lower part of the vacuum cleaner's main casing where a dust collecting unit or the like are provided, a cleaning unit provided with a suction port communicating with the dust collecting unit is formed, and moreover a pair of driving wheels is attached to make the main casing autonomously travel. Also, an electric blower is housed inside the main casing, and a suction side of the electric blower is communicated with the dust collecting unit. Then, as the electric blower is driven, dust and dirt are sucked along with air via the suction port into the dust collecting unit, thus cleaning.

With such a vacuum cleaner as described above, there are some cases where the cleaning unit is made up/down movable relative to the main casing so as not to catch on any step gap of the cleaning-object surface or the like. Accordingly, there is a need to prevent any impairment of the communication between the suction port and the dust collecting unit during such up/down movement of the cleaning unit.

CITATION LIST

Patent Literature

PTL 1: Japanese Patent Publication No. 4364441

Technical Problem

An object of the present invention is to provide a vacuum cleaner capable of ensuring the communication between the suction port and the dust collecting unit even in a state in which a body portion of the cleaning unit has pivoted along the up/down direction relative to the main casing.

Solution to Problem

In the present embodiment, there is provided a vacuum cleaner having a main casing, driving wheels, a cleaning unit, and a communicating section. The main casing includes an electric blower, and a dust collecting unit communicating with a suction side of the electric blower. The driving wheels enable the main casing to travel on a cleaning-object surface. The cleaning unit includes a body portion, a suction port, a sliding-contact surface portion, and a communicating port. The body portion is positioned in a lower part of the main casing and provided on the main casing so as to be pivotable along an up/down direction. The suction port is opened in the body portion so as to face the cleaning-object surface. The sliding-contact surface portion is provided in the body portion so as to face a dust collecting unit side and curved along a pivoting direction of the body portion. The communicating port is opened in the sliding-contact surface portion to communicate with the suction port. The communicating section includes a curved surface portion and a communicating opening and is interposed between the cleaning unit and the dust collecting unit and fixed to the main casing. The curved surface portion is curved along the pivoting direction of the body portion so as to be brought into sliding contact with the sliding-contact surface portion by pivoting motion of the body portion. The communicating opening is opened in the curved surface portion so as to communicate with the dust collecting unit.

DETAILED DESCRIPTION

Figure 1:
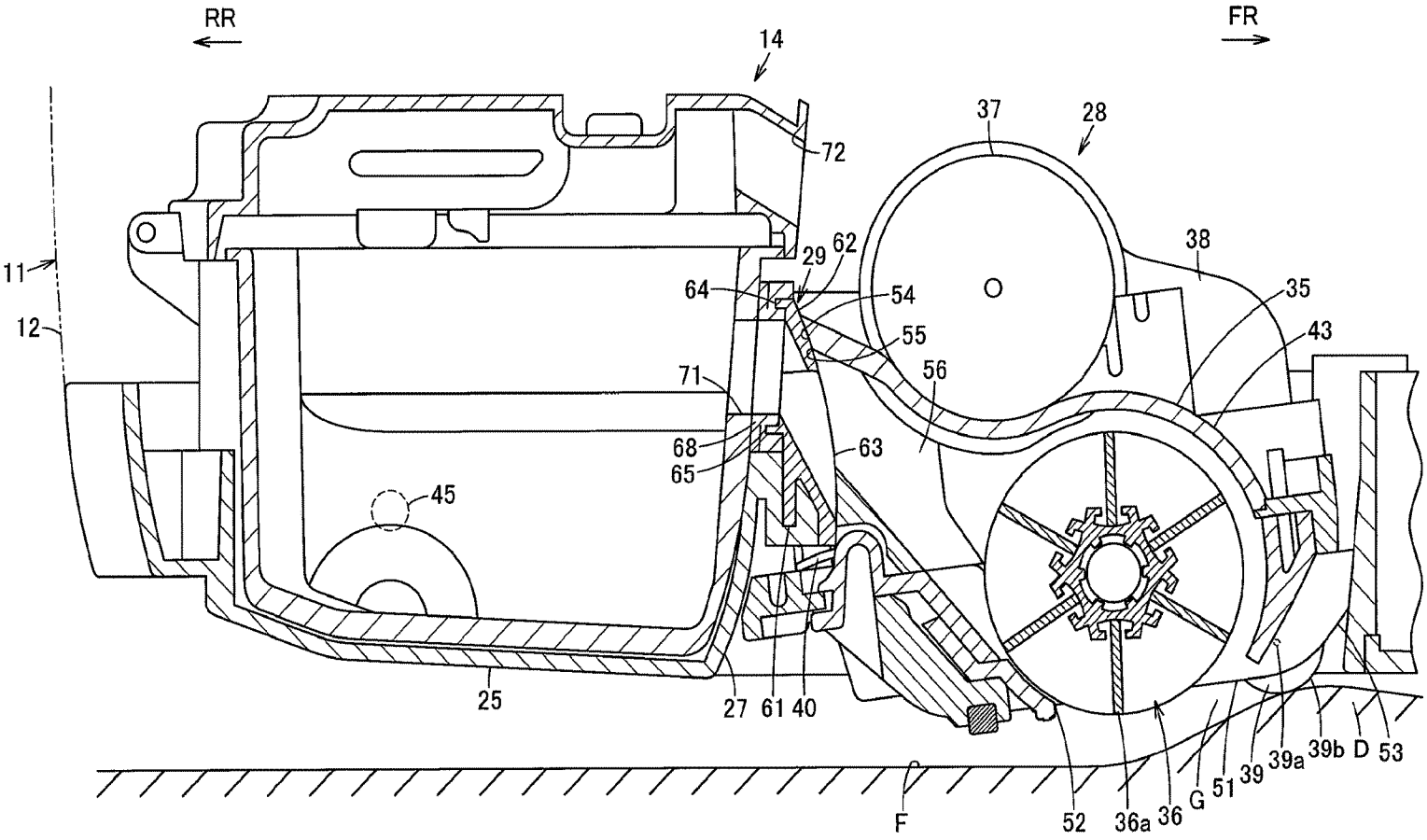
FIG. 1 is a sectional view of a vacuum cleaner in one embodiment showing a state in which its cleaning unit is positioned at a relatively upper position, as it is taken along a line I-I of FIG. 5.

Hereinbelow, an embodiment will be described in terms of its constitution with reference to FIGS. 1 to 10.

In FIGS. 1 to 10, reference sign 11 denotes a vacuum cleaner. This vacuum cleaner 11, in this embodiment, will be described hereinbelow as a vacuum cleaner 11 exemplified by a so-called self-propelled robot cleaner that, while autonomously traveling (self-propelling) on a cleaning-object surface (floor surface) F, cleans the cleaning-object surface F.

The vacuum cleaner 11 includes a hollow main casing 12, in which an electric blower 13 is housed and moreover, a dust collecting unit 14 communicating with a suction side of the electric blower 13 is removably provided so as to be positioned at a rear portion, as an example. Further, the main casing 12 is also provided with driving wheels 15 as a plurality (pair) of driving parts, a plurality of driven wheels 17, distance measuring sensors 18 as a plurality of distance detection means (distance detector parts), side brushes 19, 19 being swinging cleaning parts as a pair of cleaning parts, a control unit (controller) 22 as a control means constituting a circuit board or the like, and a secondary battery 23 as a battery constituting a power source unit. In addition, the following description will be given on the assumptions that a direction extending along the traveling direction of the vacuum cleaner 11 (main casing 12) is assumed as a back-and-forth direction (directions of arrows FR and RR shown in FIG. 1, etc.) while a left-and-right direction (directions toward both sides) crossing (orthogonally intersecting) with the back-and-forth direction is assumed as a widthwise direction, and a state in which the vacuum cleaner 11 is placed on a flat cleaning-object surface is assumed as a reference state.

The main casing 12 is formed into a flat columnar shape (disc shape) or the like by combining together a plurality of casing bodies formed from a hard synthetic resin or the like, for example. A lower surface 25, constituting a lower part of the main casing 12, is formed into a circular shape as in a plan view. In this lower surface 25, a plurality of exhaust ports 26 for discharging exhaust air from the electric blower 13 as well as an attachment opening 27 are opened, and moreover the driving wheels 15, 15 are placed at rather forward positions on both sides of the attachment opening 27. This attachment opening 27, located at a position which is a generally widthwise-central and longitudinally-rear-sided position (forward of the dust collecting unit 14) of the main casing 12, is formed into a widthwise longitudinal, i.e. oblong, quadrilateral shape. Also, the cleaning unit 28, which is a suction portion moveable in an up/down direction (upward and downward movable) relative to the main casing 12, is attached to this attachment opening 27. Then, a communicating section 29 for communicating the cleaning unit 28 and the dust collecting unit 14 to each other is interposed between the cleaning unit 28 and the dust collecting unit 14.

Meanwhile, an upper surface 31, constituting an upper part of the main casing 12, is formed into a circular shape as in a plan view. In this upper surface 31, a radio-communication part 33 for radio communication with external devices is placed at a generally widthwise-central portion of a front end portion. Further, a dust-collecting-unit lid portion 34 to be opened and closed for removal of the dust collecting unit 14 is provided in this upper surface 31.

The cleaning unit 28 (FIGS. 1 to 6) is so positioned as to face the cleaning-object surface F in a state in which the vacuum cleaner 11 is placed on the cleaning-object surface F. The cleaning unit 28 integrally includes a body portion 35 positioned in a lower part of the main casing 12 and having a lower portion exposed from the lower surface 25, a rotary brush 36 as a rotary cleaner rotatably attached to the body portion 35, a brush motor 37 as a rotation driving means (rotation driver) which is attached to the body portion 35 to generate driving force for rotationally driving the rotary brush 36, a brush gear box 38 as a transmission means (transmission part) which is attached to the body portion 35 to transmit the driving force of the brush motor 37 to the rotary brush 36, and wheels 39, 39 which are rotators as gap holding members (contact members) attached to the body portion 35. Then, the cleaning unit is biased downward against the main casing 12 by a pair of coil springs 40, 40 as biasing means (biasers) as an example.

The body portion 35 is formed from, for example, a hard synthetic resin or the like. The body portion 35 integrally includes a pair of pivotal support arms 42, 42, as an example, to be pivotally supported by the main casing 12, and a casing portion 43 to be fitted into the attachment opening 27.

The pivotal support arms 42, 42 extend linearly rearward from positions near both sides of the casing portion 43. At positions separated from tip end portions (rear end portions) of these pivotal support arms 42, 42, i.e. positions separated rearward from the casing portion 43, columnar-shaped pivotal shaft portions 45, 45 are provided so as to be protruded widthwise outward. These pivotal shaft portions 45, 45 have axial directions, respectively, extending along the horizontal direction (widthwise direction), and are positioned coaxial with each other. Then, the pivotal shaft portions 45, 45 are pivotally supported at positions on both sides of the dust collecting unit 14 and on the upper side of the lower surface 25 so as to be pivotable against the main casing 12. That is, the body portion 35 (cleaning unit 28) is pivotably supported against the main casing 12 by these pivotal shaft portions 45, 45 so that the body portion 35 (cleaning unit 28), when pivoted about the pivotal shaft portions 45, 45, can be moved up and down relative to the main casing 12, i.e., can be reciprocatively moved between the lower surface 25 of the main casing 12 and the cleaning-object surface F, both toward the lower surface 25 side and toward the cleaning-object surface F side (in a direction protruding from the lower surface 25 and in its opposite direction (counter-protruding direction)). Accordingly, the body portion 35 is so constituted that its protruding extent downward (toward the cleaning-object surface F side) from the lower surface 25 of the main casing 12 is varied by pivotal motion.

Meanwhile, the casing portion 43 has a bottom face portion 51, which is a flat surface portion, facing the cleaning-object surface F in its lower part, with a suction port 52 opened in the bottom face portion 51. Also, the casing portion 43 has a sloped surface portion 53, which is a front surface portion obliquely rising upward facing a forward direction from a front portion of the bottom face portion 51. Further, the casing portion 43 has a sliding-contact surface portion 54, which is a rear surface portion rising in a circular-arc surface shape upward from a rear portion of the bottom face portion 51, with a communicating port 55 opened in the sliding-contact surface portion 54. The casing portion 43 further has a duct portion 56 making the suction port 52 and the communicating port 55 communicate with each other.

The bottom face portion 51 extends longitudinally in the widthwise direction. Also, near both sides of the bottom face portion 51, the wheels 39, 39 are rotatably attached beside (at outer side portions of) the suction port 52. Then, in a state in which the body portion 35 (cleaning unit 28) is positioned at the lowest position relative to the main casing 12, the bottom face portion 51 is positioned below the lower surface 25, i.e., positioned so as to be protruded toward the cleaning-object surface F side and generally parallel to the lower surface 25. In addition, in a state in which the body portion 35 (cleaning unit 28) has pivoted upward relative to the main casing 12, the bottom face portion 51 may be positioned below the lower surface 25, or may be generally flush with the lower surface 25, or may be positioned, at least partly, above the lower surface 25.

The suction port 52 is formed into a quadrilateral shape extending longitudinally in the widthwise direction. In this suction port 52, the rotary brush 36 housed within the duct portion 56 is positioned, and an outer-peripheral side lower portion of the rotary brush 36 is slightly protruded downward from the suction port 52 so as to be contactable with the cleaning-object surface F. Then, the wheels 39, 39 are positioned forward of the suction port 52, while the body portion 35 is pivotably supported so as to be pivotable against the main casing 12 by the pivotal shaft portions 45, 45 at positions rearward of the suction port 52.

The sloped surface portion 53 extends longitudinally in the widthwise direction. A front side portion of the sloped surface portion 53 is sloped toward a front edge portion of the attachment opening 27.

The sliding-contact surface portion 54, which extends longitudinally in the widthwise direction, is a portion that makes sliding contact with a front portion of the communicating section 29 from a rear edge portion of the attachment opening 27 and facing the communicating section 29. The sliding-contact surface portion 54 is curved in a circular arc shape along a pivoting direction of the body portion 35 (cleaning unit 28) as viewed sideways (from the right side or left side) along the horizontal direction, i.e., curved along a circular arc (circular-arc surface) about the pivotal shaft portions 45, 45 (center axes of the pivotal shaft portions 45, 45). That is, the sliding-contact surface portion 54 is formed into a cylindrical surface shape having an axial direction along the horizontal direction (widthwise direction). In other words, the sliding-contact surface portion 54 is formed so as to be concentric with outer peripheral surfaces of the pivotal shaft portions 45, 45. Further, the sliding-contact surface portion 54 is curved facing upward so as to be gradually protruded rearward.

The communicating port 55, which makes the suction port 52 communicate with the dust collecting unit 14 (via the communicating section 29), is formed into a quadrilateral shape extending longitudinally in the widthwise direction. That is, the communicating port 55 is formed into a slit-like shape extending in the widthwise direction.

The duct portion 56 is formed from, for example, a hard synthetic resin or the like into a tubular shape so as to extend from below toward a rearward upper side over a range from the suction port 52 to the communicating port 55. Then, the interior of the duct portion 56 serves as a suction chamber through which dust-containing air sucked through the suction port 52 passes to the dust collecting unit 14 side.

The rotary brush 36 is formed into an elongate-shaft shape, having cleaning members 36*a* such as a bristle brush or a blade placed on its outer peripheral surface. As the rotary brush 36 is rotated, the cleaning members 36*a* repeatedly make contact with the cleaning-object surface F, thereby scraping up dust and dirt on the cleaning-object surface F. The rotary brush 36 is positioned in the suction chamber with both end portions pivotally supported by left-and-right both sides of the duct portion 56. That is, the rotary brush 36 has a rotational axis along the horizontal direction (widthwise direction).

The brush motor 37 is fixed, for example, on an outer side surface in an upper part of the duct portion 56. This brush motor 37 is positioned leaning towards a widthwise one-sided portion of the duct portion 56.

The brush gear box 38 is positioned at one side portion of the duct portion 56 and fixed on the body portion 35 (casing portion 43). The brush gear box 38 connects the brush motor 37 and the rotary brush 36 to each other.

The wheels 39, 39 are always in contact with the cleaning-object surface F to support the vacuum cleaner 11 (main casing 12) while allowing the body portion 35 (cleaning unit 28) to move up and down (pivot in the up/down direction) so as to follow the shape of the cleaning-object surface F. That is, these wheels 39, 39 hold a gap G between the cleaning-object surface F and the bottom face portion 51 (suction port 52) at a generally constant extent. In other words, the wheels 39, 39 hold the bottom face portion 51 (suction port 52) in a state parallel to the cleaning-object surface F with a specified gap G therebetween. These wheels 39, 39 are positioned widthwise outside, i.e., at outer positions of the suction port 52 and forward of the suction port 52. The rotating shafts 39*a*, 39*a* that are the center axes of these wheels 39, 39 are positioned coaxial with each other along the horizontal direction (widthwise direction). These rotating shafts 39*a*, 39*a* are pivotally supported by the body portion 35 (casing portion 43) at positions above the bottom face portion 51 and near the front end portion of the bottom face portion 51. By the pivotal support at these positions, lower sides and front sides of outer peripheral surfaces of the wheels 39, 39 are protruded downward and forward from the bottom face portion 51. As a result of this, front side portions of the outer peripheral surfaces of the wheels 39, 39 are protruded to the frontal lower side of a corner portion where the bottom face portion 51 and the sloped surface portion 53 adjoin each other. The outer peripheral surfaces of these wheels 39, 39 are covered with such soft members (sliding-contact members) 39*b*, 39*b* as a napped blanket or nonwoven fabric which are higher in slide-contactability, that is slidability, than the bottom face portion 51 (body portion 35).

The coil springs 40, 40, which are placed at rear portions on both side portions of the body portion 35 (casing portion 43), have their lower end portions held on the body portion 35 (casing portion 43) and upper end portions held by spring receiving parts 58 as biasing-means receiving parts (biaser receiving parts) provided in the main casing 12. These coil springs 40, 40, which are positioned rearward of the suction port 52, bias the body portion 35 (casing portion 43) downward at positions near base end portions of the pivotal support arms 42, 42.

The communicating section 29 (FIGS. 1, 2, 5 and 7) includes a communicating section body 61 formed from, for example, a hard synthetic resin or the like. This communicating section body 61 is formed longitudinally along the widthwise direction. The communicating section body 61 is attached to an upper portion of the lower surface 25 at a rear edge portion of the attachment opening 27 so as to be interposed between the cleaning unit 28 and the dust collecting unit 14 and fixed to the main casing 12. Also, the communicating section body 61 has a curved surface portion 62 opposed to the cleaning unit 28, where the curved surface portion 62 is formed into a curved surface shape slidingly contactable with the sliding-contact surface portion 54 of the cleaning unit 28 (body portion 35). The curved surface portion 62 has a communicating opening 63 opened therein. The communicating section body 61 further has a flat surface-shaped connecting surface portion 64 facing the dust collecting unit 14. In this connecting surface portion 64, a ventilation opening 65 communicating with the communicating opening 63 is opened. Accordingly, the communicating section body 61 is formed into a tubular shape having an axial direction along the back-and-forth direction.

The curved surface portion 62 is a portion which makes sliding contact with the sliding-contact surface portion 54 opposed to a rear portion of the body portion 35 (casing portion 43) of the cleaning unit 28, and which extends longitudinally in the widthwise direction. In this embodiment, the curved surface portion 62 is in direct sliding contact with the sliding-contact surface portion 54 closely with generally no gap therebetween. Also, the curved surface portion 62 is curved in a circular-arc shape along the pivoting direction of the body portion 35 (cleaning unit 28), i.e. curved along a circular arc (circular-arc surface) about centers of the pivotal shaft portions 45, 45 (center axes of the pivotal shaft portions 45, 45), as viewed sideways (from the right side or left side) along the horizontal direction. Thus, the curved surface portion 62 has a curvature generally equal to that of the sliding-contact surface portion 54. That is, the curved surface portion 62 is formed into a cylindrical surface shape having an axial direction along the horizontal direction (widthwise direction). In other words, the curved surface portion 62 is formed so as to be concentric with the outer peripheral surfaces of the pivotal shaft portions 45, 45. Then, the curved surface portion 62 is curved facing upward so as to be gradually protruded rearward. Further, the curved surface portion 62 is so formed as to maintain sliding contact with the sliding-contact surface portion 54 over an entire range in which the body portion 35 (cleaning unit 28) is up/down moved (pivoted in the up/down direction) relative to the main casing 12.

The communicating opening 63 is formed into a quadrilateral shape extending longitudinally in the widthwise direction. This communicating opening 63 is communicatable, via the ventilation opening 65, with the dust collecting unit 14 attached to the main casing 12. Also, the communicating opening 63 is communicated with the communicating port 55 opened in the sliding-contact surface portion 54 of the body portion 35 (cleaning unit 28) that makes sliding contact with the curved surface portion 62. The communicating opening 63 maintains communication with the communicating port 55 by sliding contact between the curved surface portion 62 and the sliding-contact surface portion 54 over an entire range in which the body portion 35 (cleaning unit 28) is up/down moved (pivoted in the up/down direction) relative to the main casing 12. Accordingly, the communicating opening 63 is always communicated with the suction port 52 (suction chamber) (via the communicating port 55).

The connecting surface portion 64 is formed, for example, so as to extend longitudinally in the widthwise direction and extend generally vertically along the up/down direction. In this connecting surface portion 64, a sealer 68 is attached along a peripheral edge portion of the ventilation opening 65. The sealer 68, which is in pressure contact with the dust collecting unit 14 attached to the main casing 12, is formed into a quadrilateral frame shape to maintain airtightness of the connection with the dust collecting unit 14. The sealer 68 is formed from a member made of rubber or the like as an example so as to be elastically deformable.

The ventilation opening 65 is formed into a quadrilateral shape extending longitudinally in the widthwise direction. The ventilation opening 65 is formed so as to adjoin to the communicating opening 63 smoothly without any step gap.

The electric blower 13 is housed in the main casing 12 at a position between the driving wheels 15, 15 as an example. The suction side of the electric blower 13 is airtightly connected to the dust collecting unit 14 via an unshown communicating air path portion.

The dust collecting unit 14 (FIG. 7), which is to internally accumulate dust and dirt sucked through the suction port 52 due to drive of the electric blower 13, is provided in this embodiment as a dust collecting box removably fittable to the main casing 12. Opened in this dust collecting unit 14 are an introduction port 71 which is put into pressure contact with a rear end portion of the sealer 68 of the communicating section 29 and airtightly connected to the ventilation opening 65 in a state of attachment to the main casing 12, and a discharge port 72 which is airtightly connected to the communicating air path portion in the state of attachment to the main casing 12. The introduction port 71 is opened longitudinally in the widthwise direction at a frontal lower-side position facing the connecting surface portion 64 (ventilation opening 65 and sealer 68) of the communicating section 29. Also, the discharge port 72 is opened at a frontal upper-side position facing the communicating air path portion as an example. That is, these introduction port 71 and discharge port 72 are juxtaposed above and below on the front side, similarly for both ports, in the dust collecting unit 14. In addition, although dust and dirt accumulated in the dust collecting unit 14 can be discarded through the introduction port 71 or the discharge port 72 in a state that the dust collecting unit 14 has been removed from the main casing 12 by opening the dust-collecting-unit lid portion 34, it is also allowable to additionally provide an openable/closable dust-and-dirt disposal port for easier disposal of dust and dirt.

The driving wheels 15, 15 enable the main casing 12 to travel (autonomously travel) on the cleaning-object surface F, i.e. are intended for traveling use. The driving wheels 15, 15, each formed into a disc shape having a rotational axis along the horizontal direction (widthwise direction), are placed apart from each other in the widthwise direction at positions near a back-and-forth direction center in a lower part of the main casing 12. Then, these driving wheels 15, 15 are rotationally driven via motors 74, 74 (FIG. 8) as driving means (drivers).

These motors 74, 74 are connected to these driving wheels 15, 15, respectively, via gearboxes as unshown drive transmission means (drive transmission parts), thus making it possible to drive the driving wheels 15, 15 independently of each other. Then, these motors 74, 74 are integrally biased toward such directions as to be protruded downward from the lower surface 25 of the main casing 12 together with the driving wheels 15, 15 and the individual gearboxes by unshown suspending means (suspensions). By this biasing, gripping force of the driving wheels 15, 15 against the cleaning-object surface F is ensured.

The driven wheels 17 (FIG. 9) are placed, so as to be rotatable as required, at positions in the lower surface 25 of the main casing 12 where the weight of the vacuum cleaner 11 can be supported with a good balance together with the driving wheels 15, 15. In particular, a driven wheel 17 provided at a front position of the lower surface 25 of the main casing 12 in its generally central portion in the widthwise direction serves as a swing wheel 77 swingably attached to the lower surface 25 parallel to the cleaning-object surface F.

The distance measuring sensors 18 are noncontact type sensors such as ultrasonic sensors or infrared sensors, for example. The distance measuring sensors 18 are placed, for example, in a front portion or over a region stretched to both side portions of the outer circumferential surface of the main casing 12, and are enabled to detect the presence or absence of any forward obstacle (wall portion) and sideward obstacle (wall portion) as viewed from the main casing 12, the distance of such an obstacle to the main casing 12, or the like.

The side brushes 19, 19 are to scrape together and clean dust and dirt placed at positions to which the suction port 52 does not reach, on both sides of the suction port 52, particularly positions outside the outer frame (outer peripheral surface) of the main casing 12 or positions ahead of the driving wheels 15, 15 such as wall proximities. For example, the side brushes 19, 19 are placed at positions on widthwise both sides of the main casing 12, in this embodiment, at oblique both sides (in forward left-and-right 45° directions of the main casing 12) forward of a back-and-forth central portion of the main casing 12. Each of these side brushes 19, 19 includes a brush body 81 as a cleaning-part body which is movable radially along the radial direction of the main casing 12, a brush biasing means (brush biaser) as an unshown cleaning-part biasing means (cleaning-part biaser) for biasing the brush body 81 in a direction of protruding from the outer frame (outer peripheral surface) of the main casing 12, a cleaner member 83 such as a bristle brush rotatably placed at a lower portion of the brush body 81 facing the cleaning-object surface F, and a swing motor 84 (FIG. 8) as a swing driving means (swing driver) for rotating the cleaner member 83.

The brush body 81 is movable between one position of protruding outward from the outer frame (outer peripheral surface) of the main casing 12 to another position of being generally flush with the outer frame. Then, the brush body 81, when coming into contact with an obstacle or the like, is withdrawn toward the main casing 12 side against the biasing of the brush biasing means.

The swing motor 84 is integrally attached to the brush body 81 so as to rotate the cleaner member 83 in parallel to the cleaning-object surface F, i.e., to swing the cleaner member 83. In this embodiment, the swing motors 84, 84 swing the cleaner members 83, 83 in mutually opposite directions so that dust and dirt on both sides of the main casing 12 are scraped together toward the widthwise center side of the main casing 12. That is, one swing motor 84 of the side brush 19 positioned on the left side swings the cleaner member 83 clockwise (rightward turn) while the other swing motor 84 of the side brush 19 positioned on the right side swings the cleaner member 83 counterclockwise (leftward turn).

The control unit 22 includes a clock means (clocking part) such as a timer, for example, a storage means (storage part) such as memory, and a control unit main body such as a microcomputer. The control unit 22 is electrically connected to the electric blower 13, the distance measuring sensors 18, the radio-communication part 33, the brush motor 37, the motors 74, 74, and the swing motors 84, 84 so as to control the drive of the driving wheels 15, 15 via the motors 74, 74 based on detection results from the distance measuring sensors 18. By this control, it is implementable that the main casing 12 (vacuum cleaner 11) is made to autonomously travel so as to avoid obstacles while the drive of the electric blower 13, the brush motor 37, the swing motors 84, 84 or the like is controlled so as to make the vacuum cleaner 11 clean.

The secondary battery 23 (FIG. 8) supplies electric power to the control unit 22, the electric blower 13, the distance measuring sensors 18, the brush motor 37, the motors 74, 74, the swing motors 84, 84 or the like. The secondary battery 23 is placed, for example, at a position between the driving wheels 15, 15 rearward of the swing wheel 77. Then, the secondary battery 23 is electrically connected to a charging terminal positioned in the lower surface 25 of the main casing 12, thus being enabled to charge when its charging terminal is connected to an unshown specified charging stand provided at a specified position indoors (in a room) as an example.

Next, operation of the above-described one embodiment will be described.

When the vacuum cleaner 11 is placed on the cleaning-object surface F, the driving wheels 15, 15 are brought into contact with the cleaning-object surface F so that the driving wheels 15, 15 sink together with the gearboxes into the main casing 12 against the biasing of the suspending means by self weight of the vacuum cleaner 11 to such a position that the driven wheels 17 (swing wheels 77) come into contact with the cleaning-object surface F. In this state, the cleaning unit 28 is such that outer peripheral surfaces (soft members 39*b*) of the individual wheels 39, 39 are in contact with the cleaning-object surface F, causing a specified gap G to be formed between the cleaning-object surface F and the bottom face portion 51, i.e., between the suction port 52 and the cleaning-object surface F (FIGS. 1 to 4). Then, for example, when time has come to a specified time preparatorily set in the control unit 22 or the like, the vacuum cleaner 11 makes the electric blower 13 driven to start cleaning from the charging stand as an example. In addition, the start position for cleaning may be set to any arbitrary place such as a traveling start position of the vacuum cleaner 11 or an entrance of the room or the like.

Figure 2:
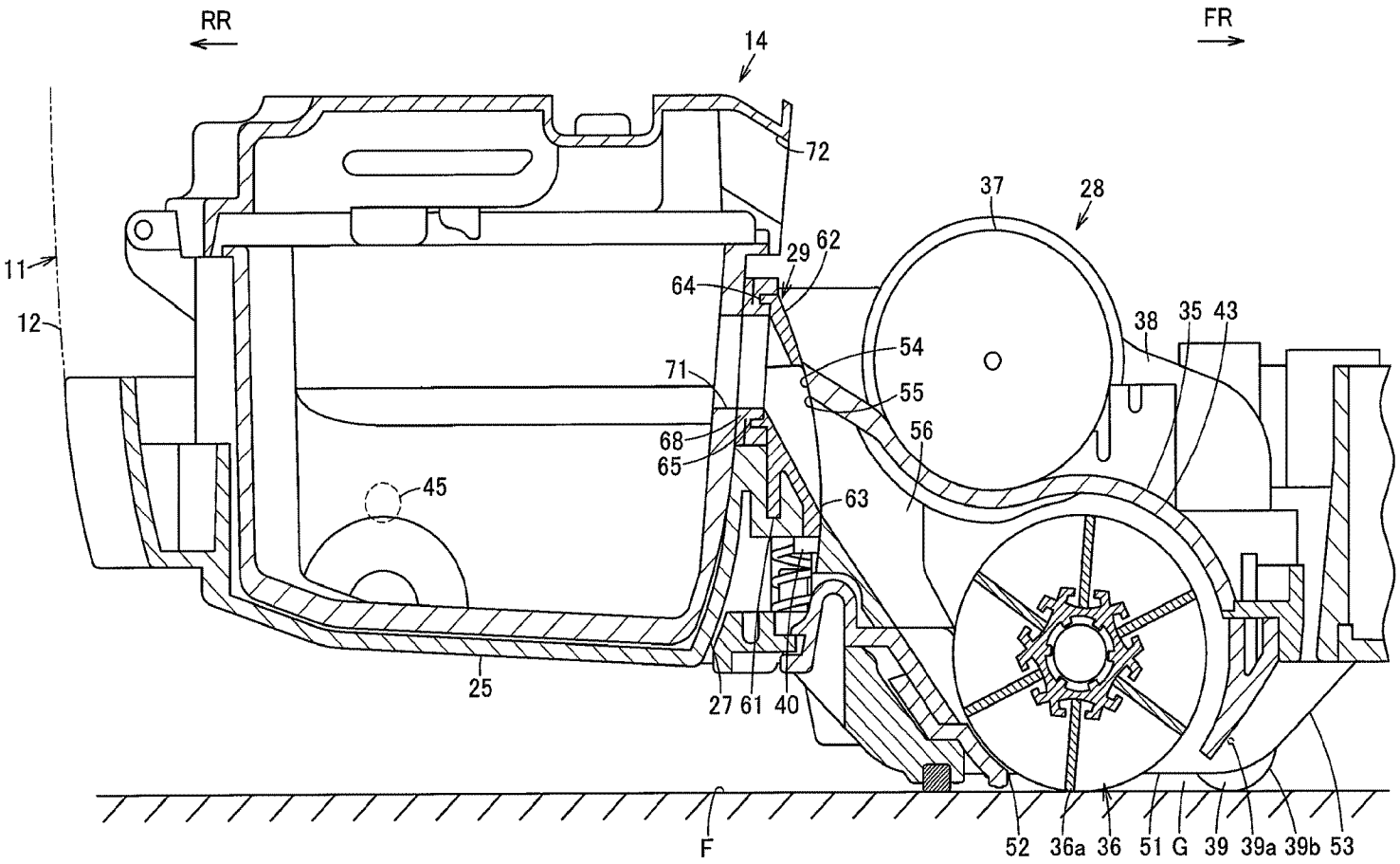
FIG. 2 is a sectional view showing a state in which the cleaning unit is positioned at a relatively lower position, as it is taken along the line I-I FIG. 5.
Figure 3:
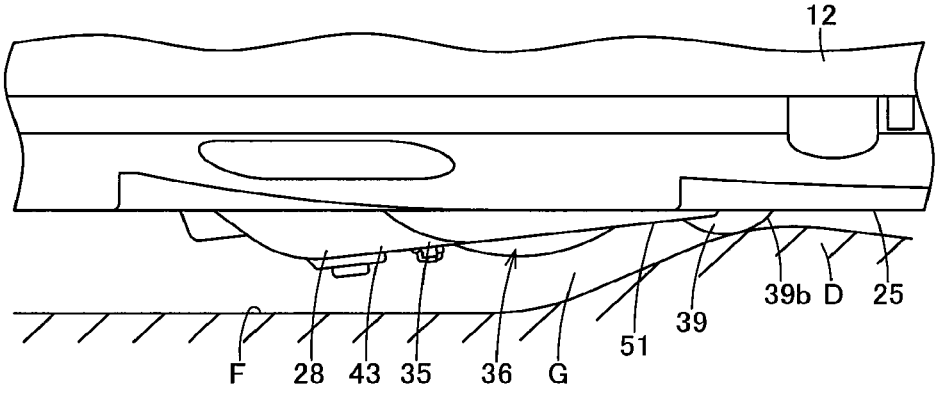
FIG. 3 is a side view showing a state in which the cleaning unit is positioned at a relatively upper position.
Figure 4:
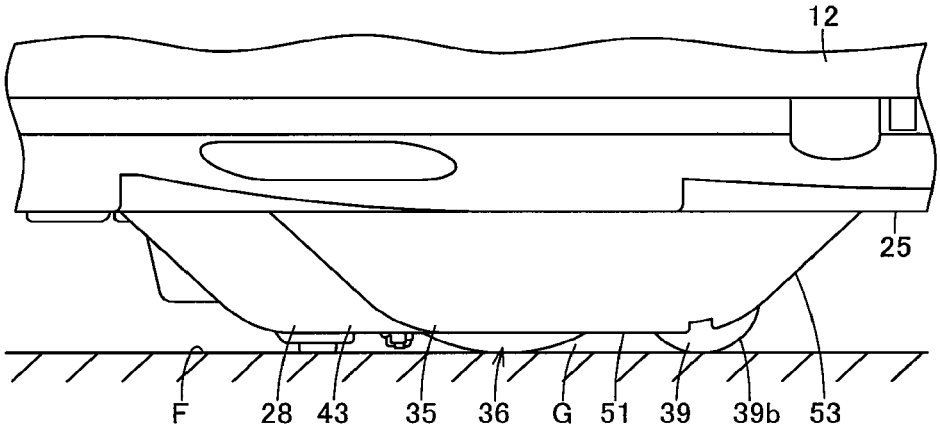
FIG. 4 is a side view showing a state in which the cleaning unit is positioned at a relatively lower position.
Figure 5:
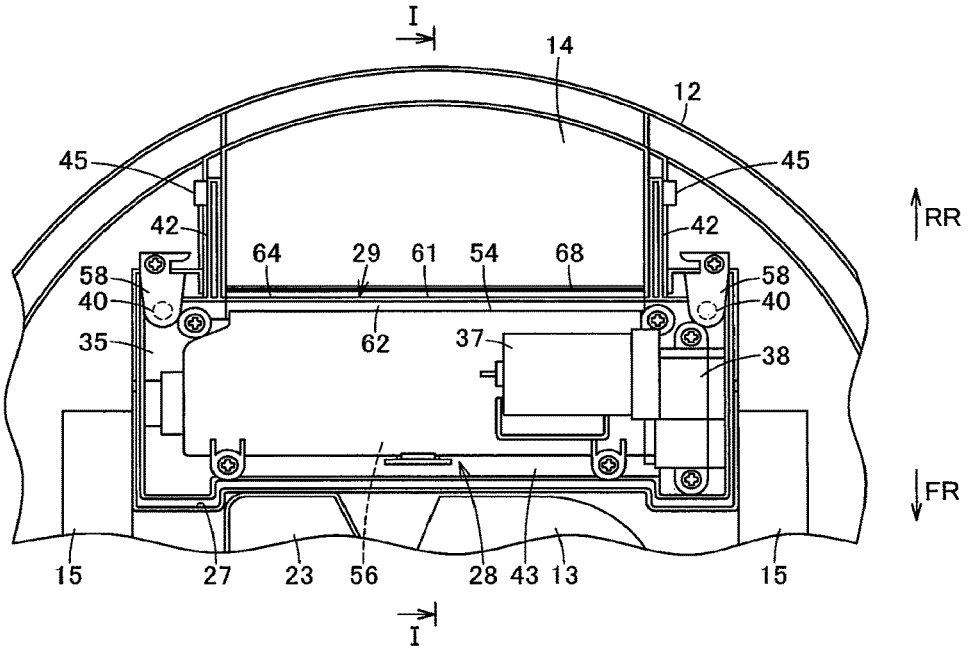
FIG. 5 is a plan view schematically showing part of inside of the main casing of the vacuum cleaner.
Figure 6:
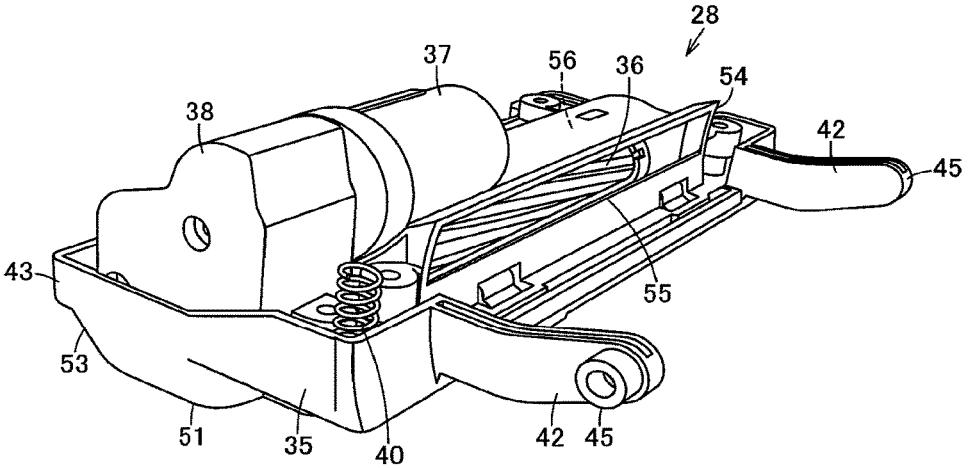
FIG. 6 is a perspective view showing the cleaning unit of the vacuum cleaner.
Figure 7:
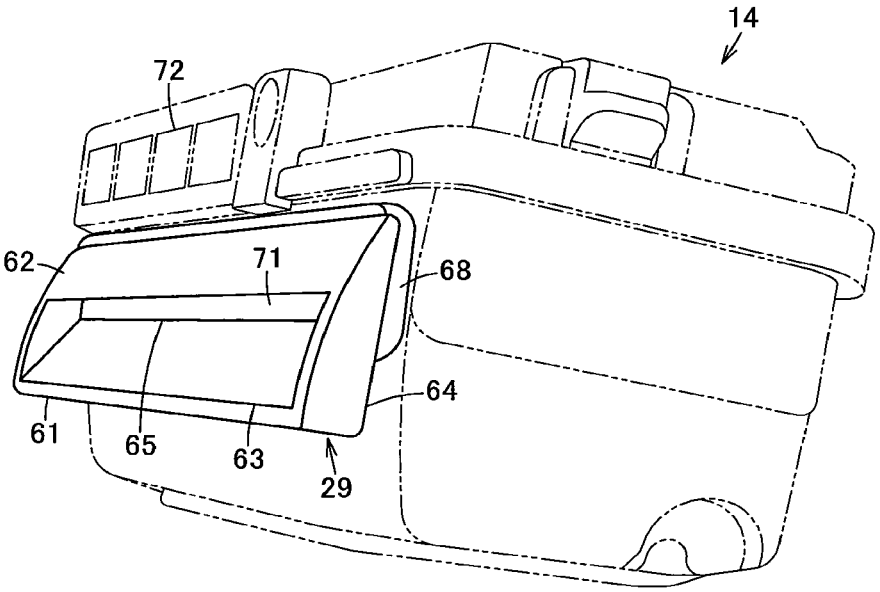
FIG. 7 is a perspective view showing a communicating section of the vacuum cleaner.
Figure 8:
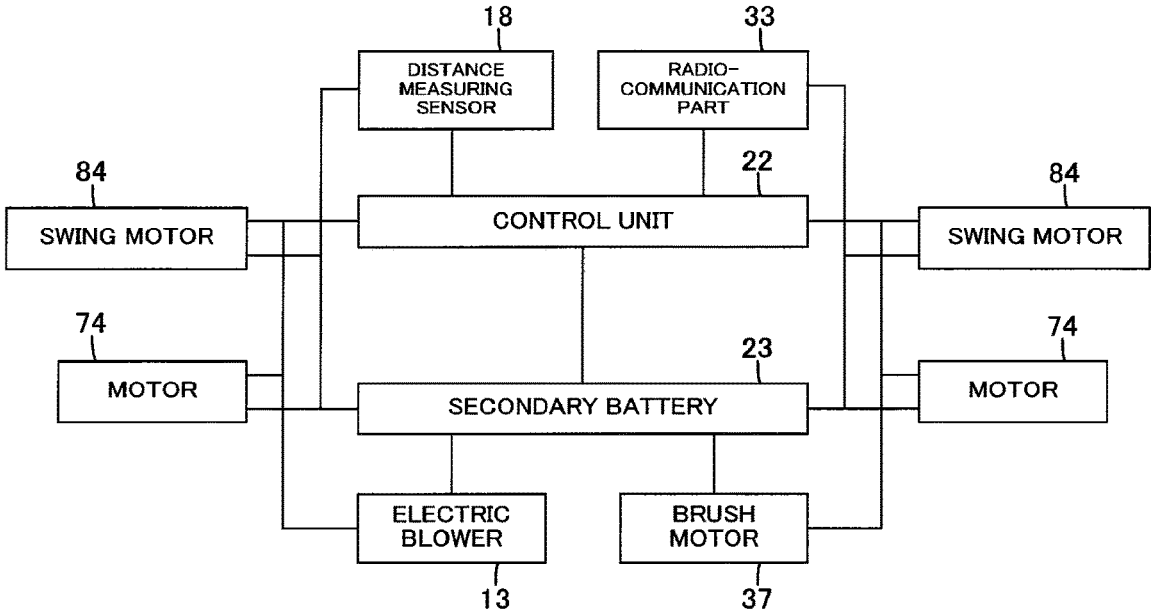
FIG. 8 is a block diagram showing an internal structure of the vacuum cleaner.
Figure 9:
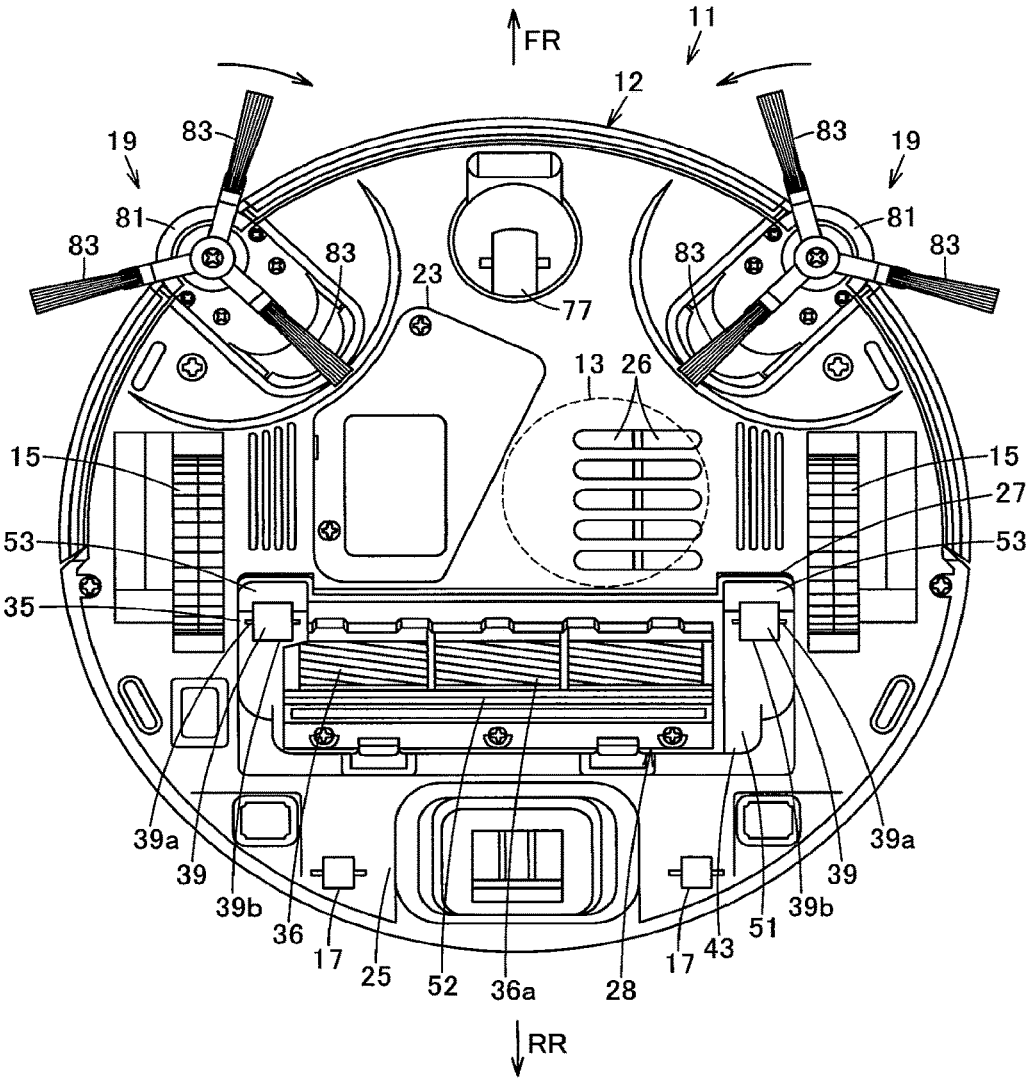
FIG. 9 is a plan view showing the vacuum cleaner as viewed from below.
Figure 10:
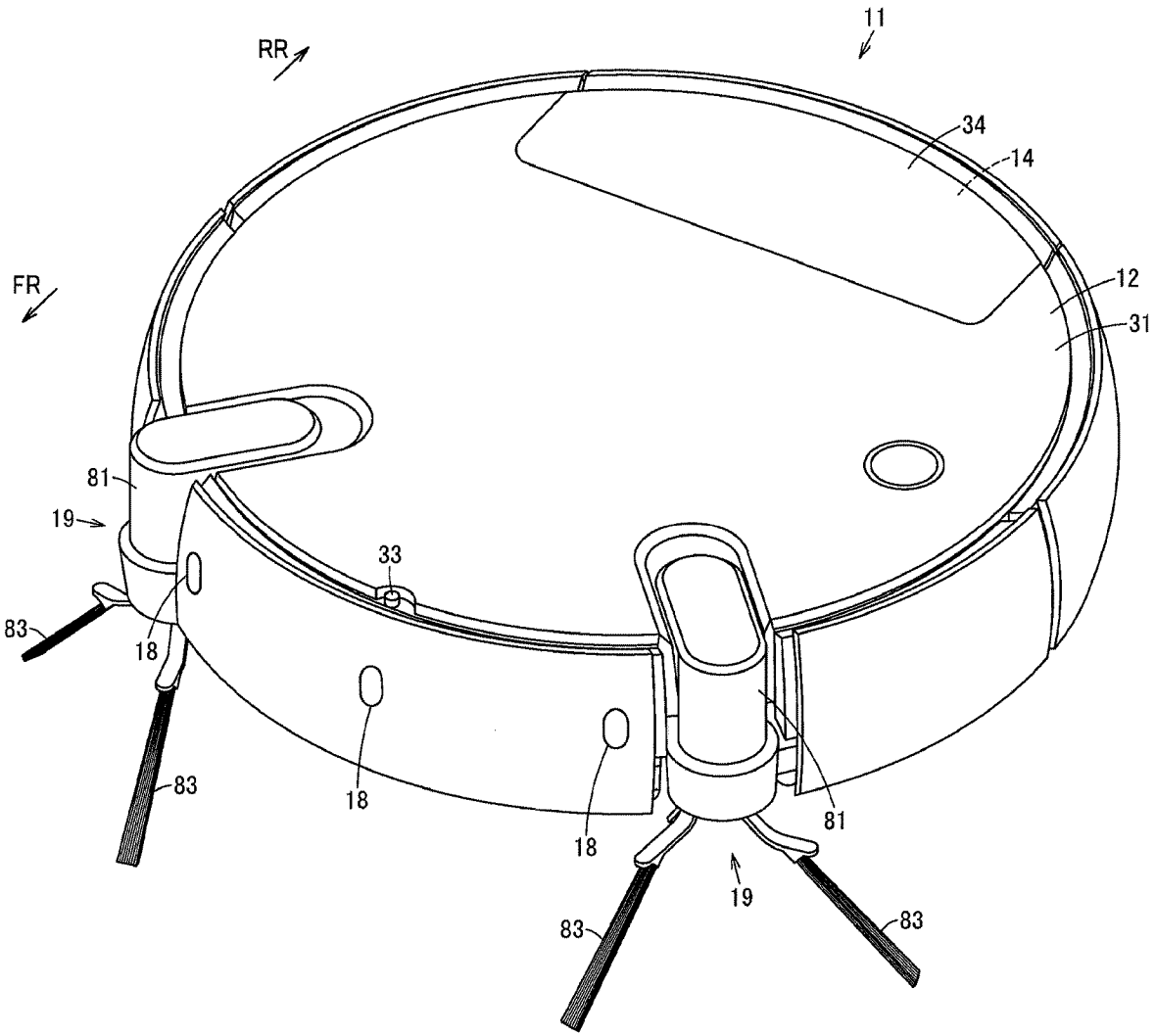
FIG. 10 is a perspective view showing the vacuum cleaner.

With this vacuum cleaner 11, the control unit 22 drives the electric blower 13 and monitors the position and traveling state of the vacuum cleaner 11 by detecting distances to a wall portion surrounding a cleaning area and an obstacle within the cleaning area or the like, for example, via the distance measuring sensors 18, under which conditions the motors 74, 74 allow the vacuum cleaner 11 to travel on the cleaning-object surface F while avoiding obstacles in response to detection from the distance measuring sensors 18. During this operation, in the cleaning unit 28, the body portion 35 is biased downward while the outer peripheral surfaces (soft members 39*b*) of the individual wheels 39, 39 maintain a state of contact with the cleaning-object surface F. Thus, even if there is a step gap (pit or bump) D on the cleaning-object surface F, the body portion 35 moves up and down to follow the step gap D, maintaining the gap G between the bottom face portion 51 (suction port 52) and the cleaning-object surface F (FIGS. 1 to 4). Also, even if the body portion 35 of the cleaning unit 28 moves up and down, the sliding-contact surface portion 54 and the curved surface portion 62 are in sliding contact with each other with generally no gap therebetween, so that the communication between the communicating port 55 and the communicating opening 63 is maintained. Thus, the suction port 52 communicating with the communicating port 55 via the duct portion 56, as well as the dust collecting unit 14 communicating with the communicating opening 63 via the ventilation opening 65 and the introduction port 71, are allowed to maintain their communications (FIGS. 1 and 2). Furthermore, an area over which the communicating port 55 and the communicating opening 63 communicate with each other maintains equal to or larger than an opening area of the introduction port 71 (ventilation opening 65) of the dust collecting unit 14. That is, since the communicating port 55 and the communicating opening 63 are generally equal in width to the introduction port 71 (ventilation opening 65), a distance between a lower edge portion of the communicating port 55 and an upper edge portion of the communicating opening 63 resulting when the body portion 35 of the cleaning unit 28 has moved up and down is maintained equal to or larger than an up/down-direction length of the introduction port 71 (ventilation opening 65). In addition, the side brushes 19, 19 and the rotary brush 36 may be always operated like the electric blower 13 or may be operated only as required.

Then, the vacuum cleaner 11 sucks dust and dirt on the cleaning-object surface F faced by the suction port 52 or dust and dirt scraped together by the side brushes 19, 19 along with air through the suction port 52 on which a negative pressure generated by the drive of the electric blower 13 has acted. The suction port 52 has the gap G to the cleaning-object surface F held generally constant by the wheels 39, 39, so that the degree of vacuum is maintained generally constant and moreover generally constant sucking force can be held. Further, the rotary brush 36 scrapes up dust and dirt on the cleaning-object surface F through the suction port 52.

Dust and dirt sucked through the suction port 52 or dust and dirt scraped up to the suction port 52 is introduced and collected through the introduction port 71 into the dust collecting unit 14 via the duct portion 56 (suction chamber), the communicating port 55, the communicating opening 63 and the ventilation opening 65. Moreover, air from which dust and dirt has been separated is sucked into the electric blower 13 via the discharge port 72 and the communicating air path portion, and cools the electric blower 13 to thereafter become exhaust air, which is exhausted outside the main casing 12 through the exhaust ports 26.

Upon determination that the cleaning of the cleaning area has been completed, the control unit 22 makes the vacuum cleaner 11 autonomously travel to the charging stand position, then stops the electric blower 13 or the like and moreover makes the charging terminal connected (physically and electrically) to the charging stand to stop the motors 74, 74, thereby ending the operation and charging the secondary battery 23.

According to the one embodiment described hereinabove, the communicating section 29 interposed between the cleaning unit 28 and the dust collecting unit 14 and fixed to the main casing 12 is provided with the curved surface portion 62, which is curved along the pivoting direction of the body portion 35 and which is in sliding contact with the sliding-contact surface portion 54 on the communicating port 55 side of the body portion 35 by pivoting of the body portion 35. Moreover, in this curved surface portion 62, the communicating opening 63 to communicate with the dust collecting unit 14 is opened. As a result of this, even in the state that the body portion 35 of the cleaning unit 28 has pivoted along the up/down direction relative to the main casing 12, the sliding-contact surface portion 54 with the communicating port 55 opened therein and the curved surface portion 62 with the communicating opening 63 opened therein maintain sliding contact with each other, so that the communication between the suction port 52 and the dust collecting unit 14 can be ensured.

In particular, in this embodiment, in order that the cleaning unit 28 is prevented from running aground (catching) on the cleaning-object surface F and the gripping force of the driving wheels 15, 15 against the cleaning-object surface F is not lessened, the wheels 39, 39 are protruded downward from the bottom face portion 51 of the body portion 35 facing the cleaning-object surface F so that the body portion 35 is pivoted to move up and down while following the cleaning-object surface F due to contact of the wheels 39, 39 with the cleaning-object surface F. With the constitution described above, the communication between the suction port 52 and the dust collecting unit 14 can be ensured during such pivoting motion, and dust and dirt can securely be sucked into the dust collecting unit 14 irrespective of pit-and-bump shapes of the cleaning-object surface F.

Still, the communicating area between the communicating opening 63 and the communicating port 55 becomes equal to or larger than the opening area of the introduction port 71 in the dust collecting unit 14 over the entire up/down moving range of the body portion 35. Therefore, whichever position the body portion 35 has pivoted to, suction pressure remains unchanged so that dust and dirt sucked by the negative pressure of the electric blower 13 or dust and dirt scraped up by the rotary brush 36 can securely be led to the dust collecting unit 14.

In addition, although the sliding-contact surface portion 54 is configured to make direct sliding contact with the curved surface portion 62 in the above-described one embodiment, it is also allowable that, for example, a seal member such as seal packing or the like is attached at a position around the communicating port 55, where the seal member is brought into sliding contact with the curved surface portion 62. In this case, forming one side of the seal member closer to the curved surface portion 62 into a sliding-contact surface portion allows the same functional effects to be produced.

Also, as the gap holding member (contact member), the wheels (rotators) 39, 39 may be replaced with a simple protrusion or the like that is contactable with the cleaning-object surface F.

As the biasing means, the coil springs 40, 40 may be replaced by using torsion springs or the like for biasing the pivotal shaft portions 45, 45 in the pivoting direction. Further, it is also allowable that the body portion 35 (cleaning unit 28) is pivoted or moved downward by weights of the rotary brush 36, the brush motor 37 and the brush gear box 38 as well as the weight of the body portion 35 (casing portion 43), without using any biasing means.

Furthermore, in the main casing 12, for example, a contact-type obstacle sensor or the like for detecting an obstacle by making contact with the obstacle may be provided on the outer peripheral surface.

Also, although the vacuum cleaner 11 has been described above as a self-propelled one that autonomously travels while detecting obstacles by the distance measuring sensors 18 or the like, other vacuum cleaners, for example, that are remote controlled by a user operating a remote control unit or the like can also be applied.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

The invention claimed is:

1. A vacuum cleaner comprising:

a main casing including an electric blower and a dust collecting unit communicating with a suction side of the electric blower;

a driving wheel for enabling the main casing to travel on a cleaning-object surface;

a cleaning unit which includes: a body portion positioned in a lower part of the main casing and provided on the main casing so as to be pivotable along an up/down direction; a suction port opened in the body portion so as to face the cleaning-object surface; a sliding-contact surface portion provided in the body portion so as to face a dust collecting unit side and curved along a pivoting direction of the body portion; and a communicating port opened in the sliding-contact surface portion to communicate with the suction port;

a communicating section which includes: a curved surface portion curved along the pivoting direction of the body portion so as to be brought into sliding contact with the sliding-contact surface portion by pivoting motion of the body portion; and a communicating opening opened in the curved surface portion to communicate with the dust collecting unit, the communicating section being interposed between the cleaning unit and the dust collecting unit and fixed to the main casing.

* * * * *